United States Patent [19]

Waite

[11] 4,184,522

[45] Jan. 22, 1980

[54] MECHANIZED BAG FILLING APPARATUS

[75] Inventor: Jerry A. Waite, Racine, Wis.

[73] Assignee: J. I. Case Company, Racine, Wis.

[21] Appl. No.: 937,647

[22] Filed: Aug. 28, 1978

[52] U.S. Cl. ..... 141/231; 414/523

[51] Int. Cl.[2] ..... B65B 1/04

141/231; 129–191; 250–284; 232; 233; 312–317; 114; 10; 67; 68; 414/523; 193/1

[58] Field of Search ..... 198/316, 318, 311, 632; 414/523; 193/1

[56] References Cited

U.S. PATENT DOCUMENTS

| | | | |
|---|---|---|---|
| 186,892 | 1/1877 | Sondermeyer et al. | 141/231 |
| 726,149 | 4/1903 | Courtland | 141/231 |
| 1,376,249 | 4/1921 | Buehler | 141/231 |
| 1,495,886 | 5/1924 | Craite | 141/231 |
| 2,463,085 | 3/1949 | Byberg | 141/231 |
| 2,619,271 | 11/1952 | McHale et al. | 141/231 |
| 2,850,052 | 9/1958 | Solie | 141/231 |
| 3,814,149 | 6/1974 | Dunavant | 141/231 |

FOREIGN PATENT DOCUMENTS

| | | | |
|---|---|---|---|
| 827,471 | 1/1952 | Fed. Rep. of Germany | 141/231 |
| 751,056 | 6/1933 | France | 141/231 |
| 460,975 | 1/1951 | Italy | 141/231 |

*Primary Examiner*—Houston S. Bell, Jr.

*Attorney, Agent, or Firm*—Cullen, Sloman, Cantor, Grauer, Scott & Rutherford

[57] ABSTRACT

An easily transportable and mechanized bag filling machine preferably used for filling sandbags at a high rate of speed to meet the requirement for a lare number of filled sandbags in areas where conditions such as flooding exist. The mechanized bag filling machine includes a pivotable trailer-mounted bag filling assembly comprising a receptacle with a cross auger, a conveyor, and a chute having bagging heads. The trailer-mounted assembly is conveniently movable from a transport position wherein the conveyor lies substantially horizontal on the trailer to a work position wherein the conveyor is inclined by actuating a cylinder connected at one end to the trailer and at its other end to the underside of the conveyor. The bagging heads are supported in an upright position on one end of the conveyor during transport, and they are pivoted to extend downwardly after the conveyor is elevated to an inclined position. The machine is self-contained and includes its own power plant, clamping devices to hold empty bags under the bagging heads, sealing mechanism to seal filled bags, and motors for driving the conveyor and auger in the receptacle.

13 Claims, 2 Drawing Figures

MECHANIZED BAG FILLING APPARATUS

BACKGROUND OF THE INVENTION

This invention relates to a mechanized bag filling machine which is transportable to any location, which requires minimum set-up time to become operable, and which is capable of filling bags at a high rate of speed.

Various attempts have been made to at least partially mechanize the filling of sandbags, including attachments which go on the rear of dump trucks, etc., but the majority of sandbags are filled in the same manner as they were 100 years ago. One man holds the bag and a second shovels sand into it and hand ties the bag with a piece of twine. Under emergency conditions, such as during flooding or preparing trenches during wartime, there is a need for a large volume of filled sandbags in a short period of time.

A problem exists in attempting to mechanize the bag filling operation by providing a machine that is self-contained wherein all the mechanical components, necessary for filling and sealing the bags, are mounted on an easily transportable frame. A mechanized bag filling machine must have its own power plant; material handling apparatus to transport the material from an input location to a discharge location; and bag storage and sealing capabilities. All of these components must be easily operable and accessible to operators using the machine so that it can be set-up at any location for immediate operation.

It is accordingly the general objective of the present invention to provide a mechanized sandbagging machine capable of filling large numbers of sandbags per hour and capable of operating on rough or uneven terrain. The sandbagging machine is easily transportable, and it is designed to handle wet or dry sand as well as various other types of materials.

SUMMARY OF THE INVENTION

The mechanized bagging machine of the present invention has the capability of filling 600 bags per hour utilizing a three-person crew. The bagging machine includes a pivotable trailer-mounted sandbag filling assembly comprising a receptacle with a cross auger, a conveyor, and a material directing chute having bagging heads. The trailer-mounted assembly is movable from a transport position to a work position by a hydraulically actuated cylinder connected at one end to the trailer and at its other end to the underside of the conveyor. Thus, the machine is quickly made ready for operation by merely extending the cylinder, thereby elevating the sandbag filling assembly. The trailer includes within its confines all the components necessary for filling and sealing bags at a high rate of speed.

Sand or other materials are dumped into the receptacle which has a cross auger to carry the material to a center, bottom, drop opening for dumping into the conveyor for elevation. The receptacle may be charged by a dump truck, scoop loader, backhoe or other systems including hand shovels. The receptacle has a grate over its open top to preclude the entrance of large stones, clumps of dirt, roots, etc.

The conveyor transports the material into the material directing chute which is pivotally mounted to one end of the conveyor. Material passing through the directing chute is directed to one of two bagging heads which extend downwardly to both the right and left sides of the machine. A bag selector valve in the directing chute deflects the material into either the right or left sandbag filling heads. One operator can work from either side of the machine or an operator can be stationed at each bagging head.

A pair of mechanical clamping devices are rotatably mounted on a vertical column on each side of the trailer so that an empty bag is always held beneath each bagging head. The clamping devices hold the empty bags in an open position while they are being filled. A filled bag is rotated about the column to a release position, and simultaneously, an empty bag replaces it under the respective bagging head. The operator seals the top of the filled bag by putting it into a stapling mechanism, and then the sealed bags are transported away from the machine.

A gasoline or diesel engine mounted on the trailer provides power to individually controlled hydraulic systems including hydraulic motors for turning the auger in the receptacle to break up material and move it to the bottom center of the receptacle and for driving the conveyor to transport the material to the directing chute. Each hydraulic motor has independent variable speed control and shut-off assuring ample material delivery to the center of the hopper and ample material delivery to the conveyor to the sandbag filling heads. The machine is fully self-contained and includes bag racks for storing empty bags and reservoir tanks permitting operation of the machine for extended periods of time.

Other advantages and meritorious features of this invention will be more fully appreciated from the following detailed description and the appended claims.

DETAILED DESCRIPTION OF THE INVENTION

Figure 1:
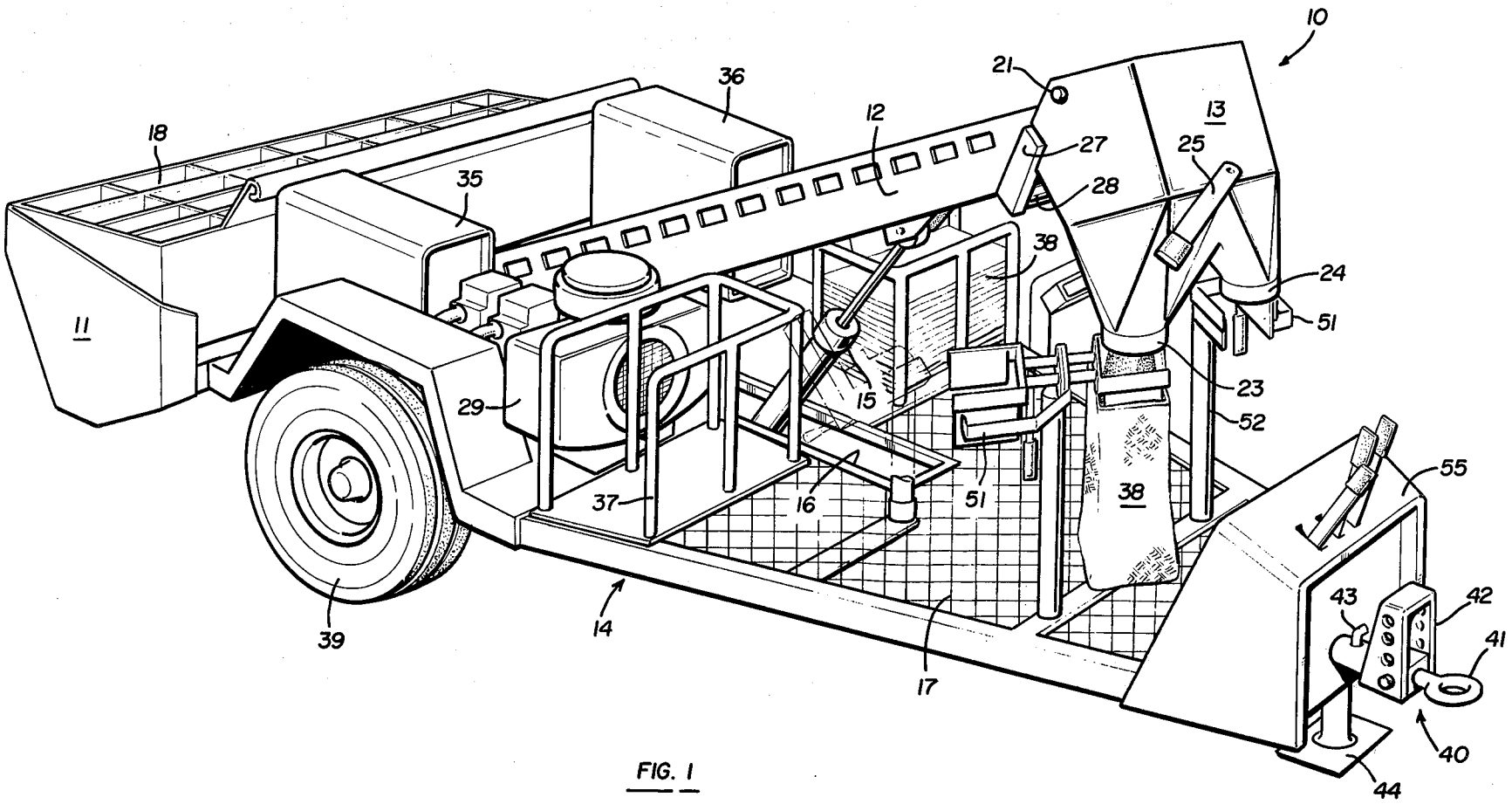
FIG. 1 is an overall perspective view of the mechanized sandbagging machine in a work position.

The teachings of the present invention, as discussed herein, are applicable to mechanized bag filling and more particularly sandbag filling. The mechanized sandbag filling machine is used wherever there exists a requirement for quick filling and sealing of large quantities of sandbags such as in areas where flooding conditions from rivers, streams, etc., are encountered. The machine is easily transportable to any location, requires a minimum of set-up time, and is capable of filling bags at a high rate of speed. It will also be understood that the bag filling machine of the present invention may be utilized for materials other than sand.

The mechanized sandbag filling machine includes a trailer-mounted sandbag filling assembly 10 comprising a receptacle 11, a conveyor 12, and a material directing chute 13. The assembly 10 is connected to trailer 14 by a transverse horizontal pivot shaft (not shown) passing through conveyor 12 to permit the conveyor pivoting movement about a horizontal axis. The pivot shaft is mounted to the trailer directly above and parallel to the axle of the ground engaging wheels 39. Assembly 10 is also connected to trailer 14 by hydraulic cylinder 15 (FIG. 1) pivotally attached at one of its ends to trailer 14 and at its other end to the underside of conveyor 12 near the pivot axis of chute 13. A feature of the present invention is that the cylinder 15 both connects assembly 10 to trailer 14 and constitutes the only element necessary to elevate the assembly to an operable position.

Figure 2:
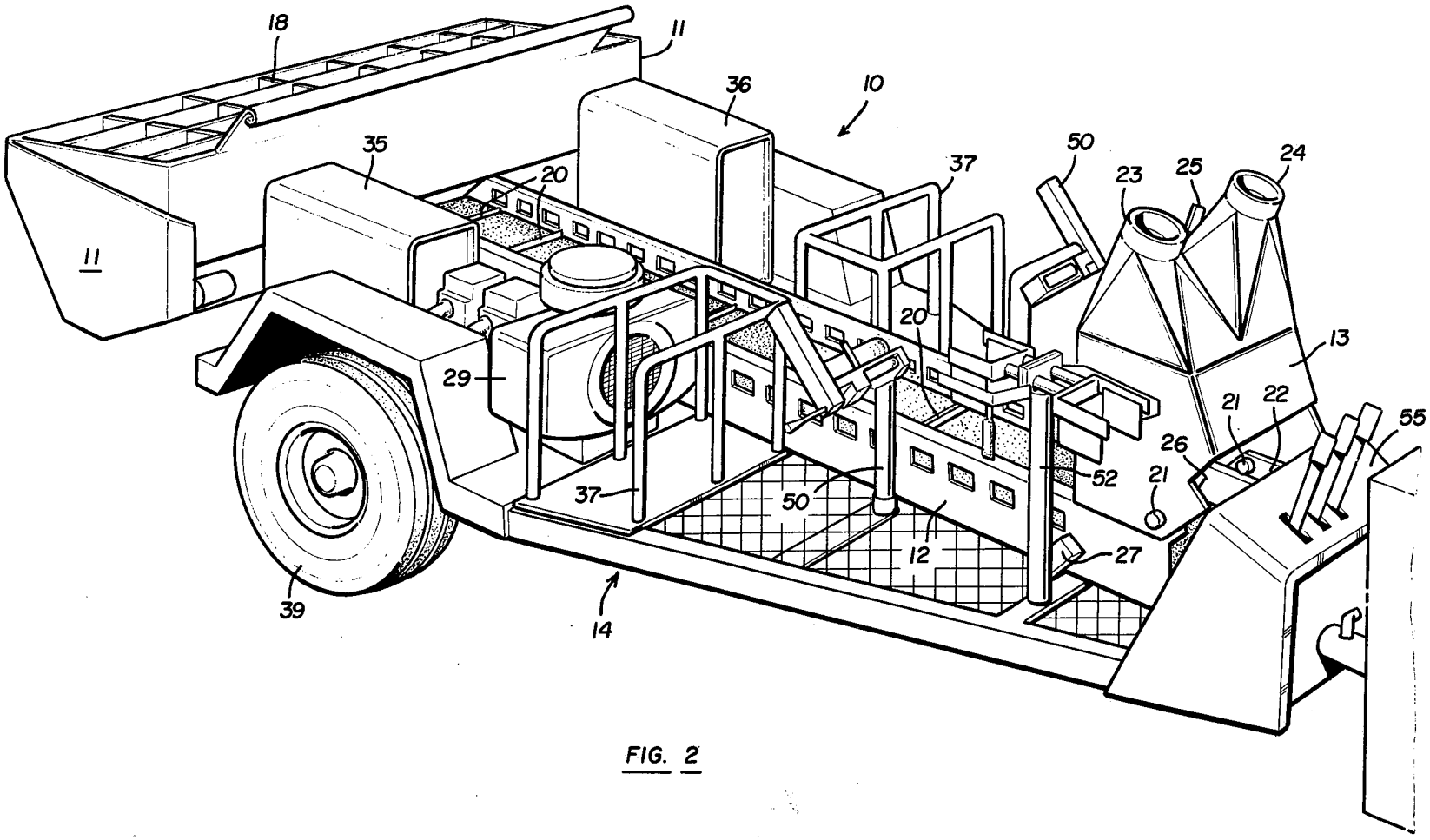
FIG. 2 is an overall perspective view of the mechanized sandbagging machine in its transport position.

The sandbag filling machine illustrated in its transport position in FIG. 2 includes conveyor 12 lying in a horizontal position supported by the bed 17 of trailer 14. Chute 13 and bagging heads 23 and 24 are turned about pivot pins 21 to a vertical, perpendicular rest position where they are supported by conveyor 12 during transport. The horizontal pivot axis 21 for chute 13 is located near the end of conveyor 12 so that chute 13 may be pivoted to an upright position and supported by conveyor 12 during transport. Roller 28 is mounted between downwardly extending conveyor support legs 27, and it extends transversely under conveyor 12 so that during transport it is interposed between the conveyor and trailer bed 17 to cushion the conveyor against bouncing and excessive vibration.

Conversion of the machine from its transport condition to an operable work condition is accomplished by extending cylinder 15 which elevates one end of conveyor 12 about its transverse horizontal pivot axis to an inclined work position and simultaneously lowers integrally attached receptacle 11 to engage the ground. FIG. 1 illustrates the conveyor 12 elevated to a work position and cylinder 15 extended whereas FIG. 2 illustrates the trailer assembly in a transport position with hydraulic cylinder 15 retracted and nested into opening 16 in grate floor 17 of trailer 14. The machine is made ready for operation by pivoting chute 13 clockwise from its position shown in FIG. 2 to its position shown in FIG. 1 so that the bagging heads 23 and 24 are directed downwardly. When chute 13 is pivoted clockwise downwardly to the position shown in FIG. 1, cut-out portion 26 abuts against conveyor support legs 27 thereby preventing the material directing chute 13 from further clockwise pivoting beyond the position illustrated in FIG. 1.

In its operable work position as illustrated in FIG. 1, the machine is charged with sand or other materials through the open top of receptacle 11. Receptacle 11 is mounted on one end of conveyor 12 and sits transversely of the longitudinal axis of the conveyor. A conventional cross auger (not shown) driven by a hydraulic motor as is known, carries sand or other material deposited into the receptacle to a bottom, open center chute (not shown) where it is dropped into the conveyor 12. The receptacle 11 has a grate 18 mounted across its open top end which precludes large stones, clumps of dirt, roots, etc., from entering the receptacle cavity. The receptacle may be charged by dump trucks, scoop loaders, backhoes, or other material handling apparatus including hand shovels.

The sand passes through the bottom, open center chute from receptacle 11 into conveyor 12, and it is elevated by paddles 20 to drop into material directing chute 13 which is pivotally mounted to the end of conveyor 12 opposite receptacle 11. Chute 13 is pivotally mounted by pins 21 to pivot plates 22 upstanding from the end of conveyor 12. As illustrated in FIG. 1, sand is directed to one of the two bagging heads 23 and 24 by turning bag selector handle 25 which pivots a baffle plate (not shown) interior of chute 13 to deflect the sand to the left, to the right, or to both bag filling heads.

A pair of mechanical clamping devices 51 are rotatably mounted on vertical columns 52 on each side of the trailer such that an empty bag 38 is always held beneath the sandbagging heads 23 and 24. An empty bag is locked into position on one of the clamping devices 51 and rotated under a respective bagging head where material is deposited into the bag. Another empty bag is locked onto the other clamping device of each pair while the first bag is filling. Filled bags are rotated on columns 52 to a release position, and simultaneously, empty bags replace them under the respective bagging heads.

Filled bags are released from the clamping devices 51 by an operator who places the tops of the bags into the stapling device 50. The sealing or stapling device 50 consists of a hydraulically operated stapling machine which seals the bag by placing a metal staple around the outer circumference of the bag neck with the tips of the staple being crimped to penetrate into the material of the bag, thereby precluding separation or opening. After sealing, the operator sets the bags onto a pallet or other suitable apparatus for transporting the bags away from the machine.

A gasoline or diesel powered engine 29 mounted on trailer 14 powers individually controllable hydraulic systems including hydraulic motors (not shown) that drive the conveyor 12 and cross auger of the receptacle 11. One motor drives the auger to break up material and move it to the bottom opening chute of the receptacle. The conveyor is driven by a separate hydraulic motor that delivers the material to the material directing chute 13 and sandbag filling heads 23 and 24. Both hydraulic motors have independent variable speed control and shut-off. Thus, the rotational speed of the auger is controlled to assure ample material delivery to the conveyor, and the conveyor speed is controlled to set the amount of material being delivered to the sandbag filling heads.

The trailer 14 has mounted on each of its sides bag racks 37 for storing stacks of empty bags 38 to be used by the operators in the sandbag filling operation. A hydraulic reservoir 35 and fuel reservoir 36 are mounted on the trailer to permit operation of the machine for extended periods of time without refueling or lubrication. The trailer 14 is designed to include all of the components necessary for bag filling and sealing so that it is completely self-contained.

The hitch 40 of the sandbag filling machine is of a telescopic design utilizing a standard lunette 41 which is compatible with pintle hooks and includes a height adjustment 42. The height adjustment 42 permits the machine to be towed by various vehicles. In the towed position, the hitch 40 is extended outwardly from the trailer 14 and locked into position by pin 43. In an operating position, the hitch is retracted under the trailer to permit operating personnel easy access to the controls 55. The machine is stabilized in an operating position by contact of the receptacle 11 with the ground, by the stabilizing leg or jack 44 at the front end of the trailer, and by the tires 39.

In operation, sand or other materials are dumped into the receptacle 11, and the cross auger carries the material to a center opening where the material is dropped into the conveyor 12 for elevation to the bagging heads 23 and 24. The elevated material drops from the conveyor into the material directing chute 13 which directs the material to one of the two bagging heads 23 or 24, depending on the setting of the bag selector handle 25. An open sandbag is held clamped onto one of the mechanical clamping devices 51 while it is being filled, and after the bag is filled, it is rotated to a position where it can be released. Thus, an operator is stationed on each side of the trailer to keep an empty bag beneath the bagging head and to remove those sandbags that have been filled.

A filled sandbag is carried by the operator to the hydraulically operated stapling device 50, and the operator inserts the neck of the bag into the stapling machine and activates a hydraulic circuit to seal the sandbag. After the bag has been sealed, the operator puts it on a pallet or other suitable apparatus for transporting the bags away from the machine. Empty bags from the bag rack 37 are installed onto the machanical clamping devices 51 for rotation under the bagging heads 23 and 24.

A third operator stands at the front of the trailer and controls the rate and speeds of operation for the auger in the receptacle 11 and the conveyor by manipulating the controls 55. This operator also controls the bag selector handle 25 to deflect the material coming into the material directing chute 13 to the right, to the left, or to both sandbag filling heads.

It will be apparent to those skilled in the art that the foregoing disclosure is exemplary in nature rather than limiting, the invention being limited only by the appended claims.

I claim:

1. A bag filling machine comprising:

a vehicular frame having a front end suitable for towing and a rear end supported by ground engaging wheels, a bag filling assembly comprising a conveyor, a receptacle mounted on one end of said conveyor, and a material directing chute pivotally mounted to the other end of said conveyor, said material directing chute having a discharge end, material moving means mounted within said receptacle, said receptacle having an opening permitting material to drop into said conveyor, movable means mounting said bag filling assembly to said vehicular frame, said movable means elevating said bag filling assembly from a transport position to a work position, said conveyor in the transport position lying substantially horizontal on said frame and said chute sitting upright on said other end of said conveyor wherein the longitudinal axis of said chute is substantially perpendicular to the longitudinal axis of said conveyor and said other end of said conveyor being between said discharge end of said chute and said frame, said conveyor in the work position being inclined and said receptacle engaging the ground, said chute being pivoted about said pivotal connection to a downwardly extending position where said discharge end of said chute being between said other end of said conveyor and said frame, power means mounted on said frame for driving said conveyor and said material moving means in said receptacle, said bag filling assembly being movable to its work position and material being dumped into said receptacle for transportation by said conveyor to said material directing chute for filling empty bags placed beneath said chute.

2. The bag filling machine as defined in claim 1 wherein said material directing chute has a cut-out portion, downwardly extending support plates being mounted on said conveyor other end below said pivot axis of said chute, whereby said cut-out portion of said chute abuts said support plates to limit the clockwise downward pivoting of said chute.

3. The bag filling machine as defined in claim 1 including a roller being mounted to the underside of said conveyor between said support plates, said roller interposed between said conveyor and said frame during transport to cushion said conveyor against bouncing and vibration.

4. The bag filling machine as defined in claim 1 wherein said movable means is a hydraulically actuated cylinder, one end of said cylinder connected to said frame and the other end of said cylinder connected to the underside of said conveyor.

5. The bag filling machine as defined in claim 1 wherein said material directing chute having plural bagging heads, bag selector means mounted in said chute and being movable to direct material into one of said bagging heads.

6. The bag filling machine as defined in claim 5 including at least one mechanical clamping device rotatably mounted on a vertical column, said vertical column being mounted to said frame, an empty bag being held by said clamping device in an open position under one of said bagging heads for filling.

7. The bag filling machine as defined in claim 6 including a sealing apparatus mounted on said frame whereby filled bags are released from said clamping device and sealed about their top open ends by said sealing apparatus.

8. The bag filling machine as defined in claim 7 including plural racks mounted on said frame for storing empty bags.

9. The bag filling machine as defined in claim 4 including a power plant mounted on said frame for driving a hydraulic system, said hydraulic system including variable speed hydraulic motors connected to said material moving means in said receptacle and to said conveyor.

10. The bag filling machine as defined in claim 1 wherein said receptacle has an open top, a grate being mounted in said receptacle open top for preventing rocks and large clumps of material from entering said receptacle.

11. The bag filling machine as defined in claim 1 wherein a hitch being mounted on the front end of said frame, said hitch being telescopic and including a height adjustment whereby the machine can be towed by various vehicles.

12. A bag filling machine comprising:

a trailer having a front end suitable for towing and a rear end supported by ground engaging wheels, a bag filling assembly comprising a conveyor, a receptacle mounted on one end of said conveyor, and a plurality of bagging heads pivotally mounted to the other end of said conveyor, said receptacle having an opening to permit material to drop into said conveyor, said bagging heads having discharge ends, movable means mounting said bag filling assembly to said trailer, said movable means elevating said bag filling assembly from a transport position to a work position, said conveyor in the transport position lying substantially horizontally on said trailer and said bagging heads sitting upright on the other end of said conveyor wherein the longitudinal axis of said bagging heads is substantially perpendicular to the longitudinal axis of said conveyor and the other end of said conveyor being between said discharge ends of said bagging heads and said trailer, said conveyor in the work position being inclined, said receptacle engaging the ground, and said bagging heads being pivoted about said pivotal connection to extend downwardly to both sides of the trailer wherein the discharge ends of said bagging heads being between said other end of said conveyor and said trailer, power means for driving said conveyor, operator means for controlling the speed of said conveyor and directing material flow to said bagging heads, first and second operator stations on either side of said trailer for filling empty bags beneath said downwardly extending bagging heads, and a third operator station for controlling the speed of said conveyor and directing material flow to said bagging heads.

13. A bag filling machine comprising:

a trailer having a front end suitable for towing and a rear end supported by ground engaging wheels, a bag filling assembly comprising a conveyor, a receptacle mounted on one end of said conveyor, and a chute pivotally mounted to the other end of said conveyor, said receptacle having an opening to permit material to drop into said conveyor, said chute having a discharge end, said conveyor being mounted to said trailer on a transverse, horizontal pivot for pivotal movement about a horizontal axis, remote controlled movable means mounted between said trailer and said conveyor, said movable means elevating said bag filling assembly from a transport position to a work position, said conveyor in the transport position lying substantially horizontal on said trailer and said chute sitting upright on said other end of said conveyor wherein the longitudinal axis of said chute being substantially perpendicular to the longitudinal axis of said conveyor and said other end of said conveyor being between said discharge end of said chute and said trailer, said conveyor in the work position being inclined and said receptacle engaging the ground, said chute being pivoted about said pivotal connection to a downwardly extending position wherein said discharge end of said chute being between said other end of said conveyor and said trailer.

* * * * *